US005571663A

United States Patent [19]

Hirai

[11] Patent Number: 5,571,663

[45] Date of Patent: Nov. 5, 1996

[54] SILVER HALIDE LIGHT-SENSITIVE MATERIAL AND COLOR FILTER

[75] Inventor: Hiroyuki Hirai, Kanagawa, Japan

[73] Assignee: Fuji Photo Film Co., Ltd., Minami-Ashigara, Japan

[21] Appl. No.: 498,412

[22] Filed: Jul. 5, 1995

[30] Foreign Application Priority Data

Jul. 7, 1994 [JP] Japan ..... 6-155726

[51] Int. Cl.[6] ..... G03C 1/46

[52] U.S. Cl. ..... 430/504; 430/358; 430/359; 430/360; 430/361; 430/362; 430/502; 430/503; 430/506

[58] Field of Search ..... 430/358, 359, 430/360, 361, 362, 502, 503, 504, 506, 944, 346

[56] References Cited

U.S. PATENT DOCUMENTS 4,705,745 11/1987 Kitchin et al. ..... 430/358

5,382,506 1/1995 Tosaka et al. ..... 430/358

FOREIGN PATENT DOCUMENTS

0295492B1 3/1991 European Pat. Off. .

*Primary Examiner*—Geraldine Letscher

*Attorney, Agent, or Firm*—Burns, Doane, Swecker & Mathis, LLP

[57] ABSTRACT

A silver halide light-sensitive material comprising a support having thereon at least four silver halide emulsion layers having different color sensitivity, wherein three layers of the silver halide emulsion layers each contains a specific coupler and the other silver halide emulsion layer contains coupler(s) capable of correcting colors so as to provide a substantially black color having a transmission density of 2.5 or more when all couplers on the support are reacted. A color filter comprising blue, green, red and black parts prepared by subjecting the above-described silver halide light-sensitive material to pattern exposure, color development, bleach-fixing and water washing.

8 Claims, 3 Drawing Sheets

SILVER HALIDE LIGHT-SENSITIVE MATERIAL AND COLOR FILTER

FIELD OF THE INVENTION

The present invention relates to a silver halide light-sensitive material suitable for producing a color filter having mosaically or stripedly disposed thereon (a) blue, green and red parts or yellow, magenta and cyan parts having excellent spectral transmission characteristics and (b) a black part having spectral absorption characteristics of high density.

BACKGROUND OF THE INVENTION

A color filter is used in, for example, a color face plate for CRT display, a photoelectric element plate for copying, a filter for single tube type TV cameras, a flat panel display using liquid crystals, and a color solid-state image sensor.

Generally employed color filters comprise regularly arranged three primary colors, i.e., blue, green and red. Color filters comprising four or more hues are also available for some uses. For example, color filters for camera tubes or for liquid crystal displays are required to have a black pattern for various purposes.

Known processes for producing these color filters include vacuum evaporation, dyeing, printing, pigment dispersion, electrodeposition, and resist electrodeposition transfer. However, color filters obtained by these processes have their several disadvantages, such as involvement of a complicated step, liability to pinholes or scratches, poor yield, and insufficient precision.

In order to solve these defects, methods for producing a color filter by an external development using a silver halide color light-sensitive material (for example, JP-A-55-6342 (the term "JP-A" as used herein means an "unexamined published Japanese patent application")) or by an internal development (for example, JP-A-62-148952, JP-A-62-71950) has been investigated. However, in the former method, the color development must be conducted at least three times so that the process is not simple. The latter method is advantageous in that a micro color filter having blue, green and red color parts having excellent spectral transmission characteristics and a black part having an optical density higher than those in the color filter parts can be easily obtained as compared with a conventional case where yellow, magenta and cyan couplers are used one by one in respective silver halide emulsion layers. However, even in this method, when blue, green and red color parts are intended to have a high spectral transmittance and an excellent color hue, since the black part has a low optical density, the light-shielding property is insufficient or the equivalent neutral density (END) is largely dislocated and, as a result, an improvement is needed.

SUMMARY OF THE INVENTION

Accordingly, an object of the present invention is to provide a silver halide color light-sensitive material having solved the above-described defects, requiring no complicated processes, favored with aptitude for mass production and suitable for producing a microcolor filter having a black part of a high optical density.

Another object of the present invention is to provide a silver halide color light-sensitive material having (a) blue, green and red parts or yellow, magenta and cyan parts having a high spectral transmittance and an excellent hue and (b) a black part close to END and having excellent light-shielding properties.

This and other objects of the present invention have been achieved by the following means (I), (II) or (III);

(I) a silver halide light-sensitive material comprising a support having thereon at least four silver halide emulsion layers having different color sensitivity, wherein three layers of the silver halide emulsion layers having different color sensitivity (a) each contains at least two couplers which form substantially different dyes selected from at least three couplers comprising a coupler forming a yellow dye, a coupler forming a magenta dye and a coupler forming a cyan dye, each by a coupling reaction with an oxidant of a developing agent, and (b) assume blue, green, and red, respectively; and one layer of the other silver halide emulsion layers contains coupler(s) capable of correcting colors so as to provide a substantially black color having a transmission density of 2.5 or more when all couplers on the support are reacted (black correction layer); and a color filter comprising blue, green, red and black parts prepared by subjecting the above-described silver halide light-sensitive material to pattern exposures, color development, bleach-fixing and water washing;

(II) a silver halide light-sensitive material comprising a support having thereon at least four silver halide emulsion layers having different color sensitivity, wherein three layers of the silver halide emulsion layers having different color sensitivity (a) each comprises at least two unit layers, and (b) assume blue, green, and red, respectively; the at least two unit layers each contains a coupler selected from at least three couplers comprising a coupler forming a yellow dye, a coupler forming a magenta dye and a coupler comprising a cyan dye, each by a coupling reaction with an oxidant of a developing agent, with the proviso that dyes formed by the couplers contained in the at least two unit layers in the silver halide emulsion layer are different from each other; and one layer of the other silver halide emulsion layers contains coupler(s) capable of correcting colors so as to provide a substantially black color having a transmission density of 2.5 or more when all couplers on the support are reacted (black correction layer); and a color filter comprising blue, green, red and black parts prepared by subjecting the above-described silver halide light-sensitive material to pattern exposure, color development, bleach-fixing and water washing; or (III) a silver halide light-sensitive material comprising a support having thereon at least four silver halide emulsion layers having different color sensitivity, wherein three layers of the silver halide emulsion layers comprises a layer containing at least a coupler forming a yellow dye, a layer containing at least a coupler forming a magenta dye, and a layer containing at least a coupler forming a cyan dye, each by a coupling reaction with an oxidant of a developing agent; and one layer of the other silver halide emulsion layers contains coupler(s) capable of correcting colors so as to provide a substantially black color having a transmission density of 2.5 or more when all couplers on the support are reacted (black correction layer); and a color filter comprising yellow, magenta, cyan and black parts prepared by subjecting the above-described silver halide light-sensitive material to pattern exposure, color development, bleach-fixing and water washing.

DETAILED DESCRIPTION OF THE INVENTION

A method for producing the color filter of the present invention will be described below.

Figure 1:
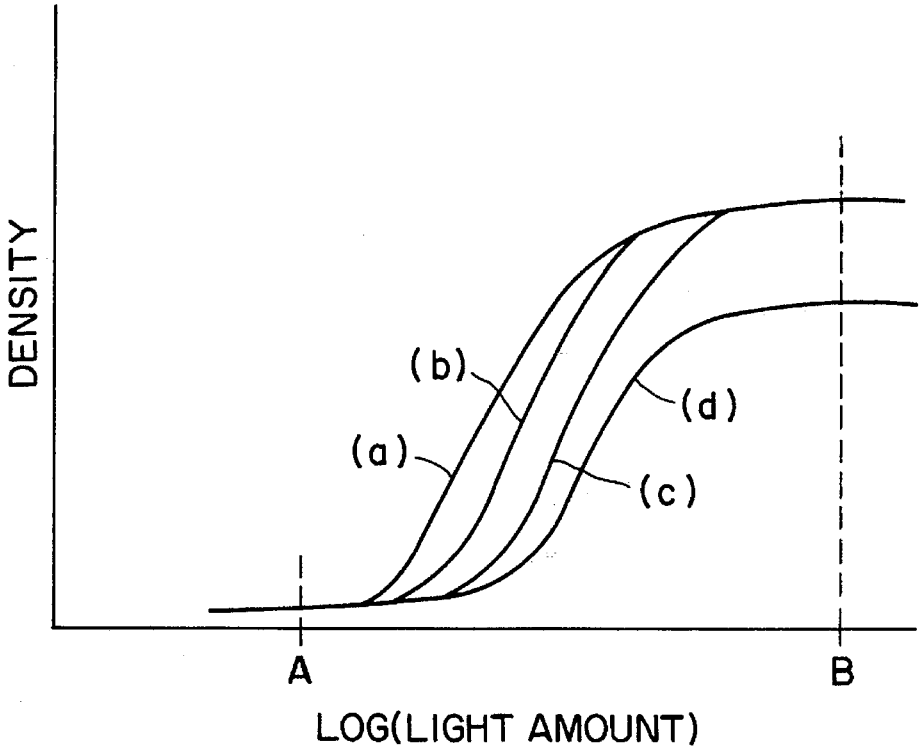
FIG. 1 shows the diagram of the characteristic curve of a silver halide light-sensitive material according to the present invention.

(I) In the first embodiment of the present invention, a silver halide light-sensitive material having the characteristic curve shown in FIG. 1 is used in which a cyan coupler and a magenta coupler are incorporated into the blue-sensitive emulsion layer, a yellow coupler and a cyan coupler are incorporated into the green-sensitive emulsion layer and a yellow coupler and a magenta coupler are incorporated into the red-sensitive emulsion layer, and furthermore, a yellow coupler, a magenta coupler and a cyan coupler are incorporated into the infrared-sensitive emulsion layer so that a substantially black color having a transmission density of 2.5 or more (END≧2.5) can be provided when all couplers on the support are reacted. Then, the material is exposed to the blue, green, red and white light (including infrared light required) using a mask filter shown in FIG. 2 having a density pattern capable of giving the exposure at positions Point A and Point B in FIG. 1. The exposed material is then subjected to color development, bleach-fixing and water washing and as a result, a color filter colored to blue, green and red and to black of high density can be obtained. In FIG. 1, (a), (b), (c) and (d) represent a red sensitive-emulsion, a green-sensitive emulsion, a blue-sensitive emulsion, and an infrared-sensitive emulsion, respectively.

Figure 2:
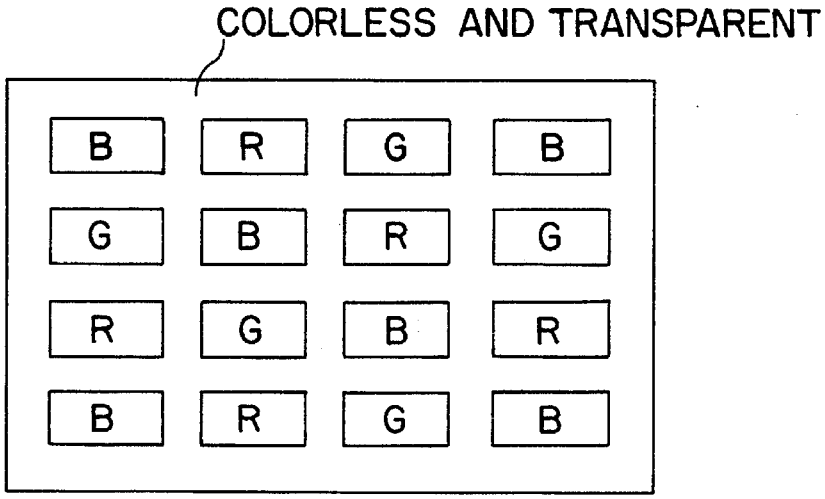
FIG. 2 shows the explanatory view of a mask filter for use in the exposure of a light-sensitive material (B: blue, G: green, R: red).
Figure 3:
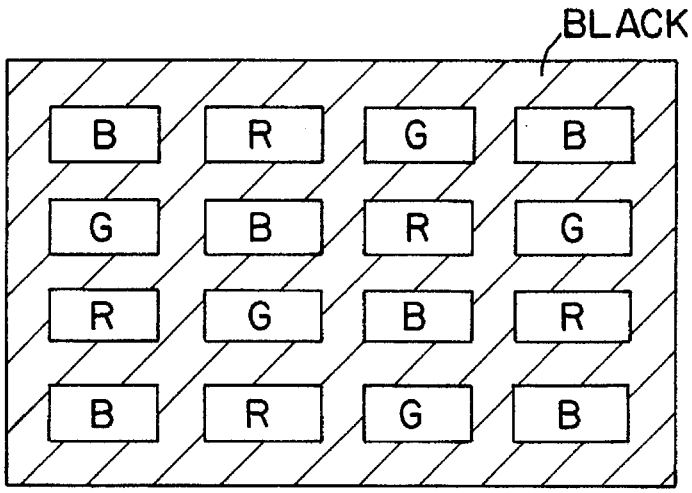
FIG. 3 shows the explanatory view of the state where the color filter of the present invention is colored (B: blue, G: green, R: red).
Figure 4:
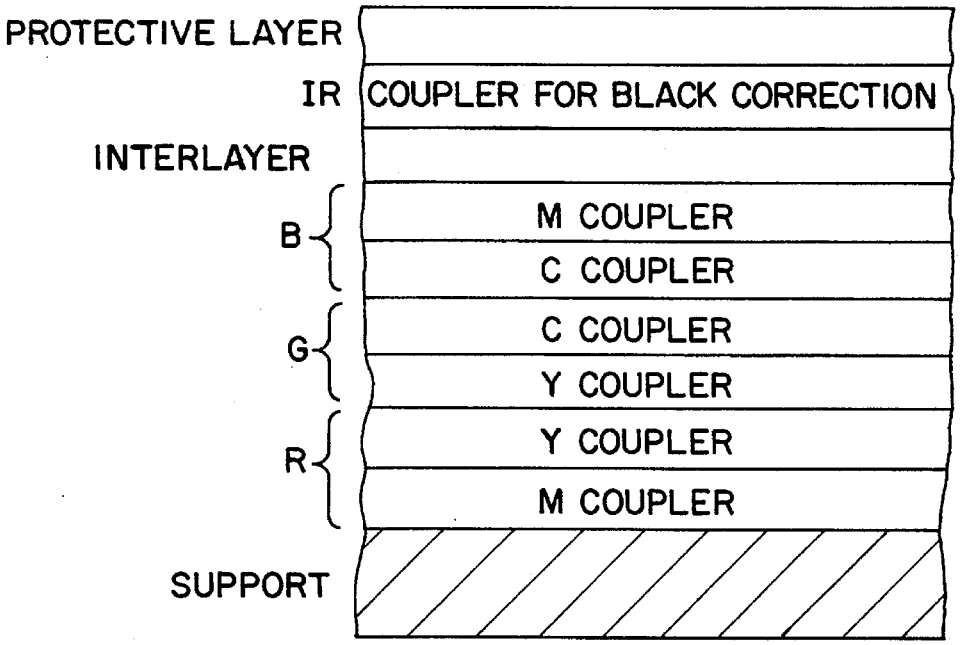
FIG. 4 shows the schematic view of the layer structure of a silver halide light-sensitive material according to the present invention (B: blue, G: green, R: red).

(II) In the second embodiment, the silver halide light-sensitive material of the present invention has a layer structure as shown in FIG. 4. As seen in FIG. 4, couplers having similar color can be added to adjacent layers of respective silver halide emulsion layers and therefore, even if an interlayer is not provided, the color mixing of dyes between the respective emulsion layers can be reduced and as a result, the color filter can be thinner. For producing a color filter using the silver halide light-sensitive material of this embodiment, the material is exposed using a mask filter as shown in FIG. 2 and then subjected to color development, bleach-fixing and water washing the same as in Embodiment (I) above. In this embodiment, three layers of silver halide emulsion layers having different color sensitivities are each constituted by at least two unit layers and the unit layers having the same color sensitivity may have different sensitivities or may have the same sensitivity. One of the above-described two unit layers contains one coupler which forms a hue different from that formed by another coupler contained in the other unit layer.

Figure 5:
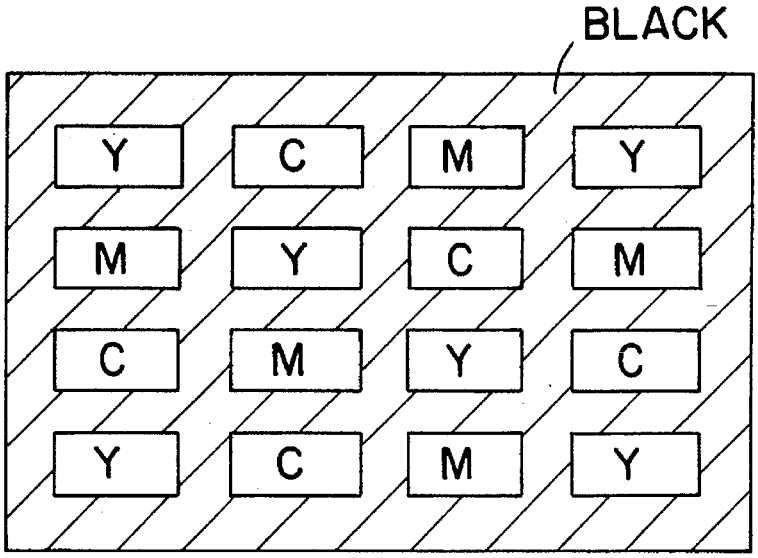
FIG. 5 shows the explanatory view of the state where the color filter of the present invention is colored (C: cyan, M: magenta, Y: yellow).

(III) In the third embodiment of the present invention, a silver halide light-sensitive layer is used in which a yellow coupler is incorporated into the blue-sensitive emulsion layer, a magenta coupler is incorporated into the green-sensitive emulsion layer and a cyan coupler is incorporated into the red-sensitive emulsion layer, and further a yellow coupler, a magenta coupler and a cyan coupler are incorporated into the infrared-sensitive emulsion layer so that a substantially black color having a transmission density of 2.5 or more (END≧2.5) can be provided when all couplers on the support are reacted. The same as Embodiment (I) above, the light-sensitive material is exposed using a mask filter as shown in FIG. 2 and then subjected to color development, bleach-fixing and water washing and as a result, a color filter colored to yellow, magenta and cyan and to black of high density can be obtained as shown in FIG. 5.

In the above-described embodiments (I), (II) and (III), four color sensitivities are not restricted only to sensitivities to blue, green, red and infrared but ultraviolet sensitivity or yellow sensitivity may be used in combination or a plurality of infrared sensitivities different in the region of light-sensitive wavelength may also be used. The coating order of four silver halide emulsion layers having different color sensitivities is not restricted to the above-described order but may be freely selected. In addition to layers in the above-described structure, a subbing layer, an interlayer, a bleachable yellow filter layer, a protective layer or an ultraviolet absorbing layer may be used, if desired. Also, the fourth silver halide emulsion layer for correcting the black color may be constituted by two or more unit layers. Couplers forming substantially different dyes may be incorporated separately into the unit layers or a plurality of couplers may be present together in each unit layer. In this case, by appropriately selecting the layer structure of each unit layer and couplers contained therein, an interlayer provided between silver halide emulsion layers adjacent with each other may be removed.

The coupler used in a black correction layer may be the same as or different from the couplers used in the three layers of the silver halide emulsion layers having different color sensitivity. Furthermore, couplers other than yellow, magenta and cyan couplers, for example, couplers which are capable of forming a color, such as red, blue, brown and black, may be used therein.

The preferable material and the preferable method for processing the material for use in the present invention will be explained below.

Silver halides in the light-sensitive silver halide emulsion layers for use in the present invention preferably include silver chloride, silver chlorobromide, silver bromide, silver iodobromide, and silver chloroiodobromide. The average iodide content is preferably 3 mol % or less, more preferably 0 mol %.

The silver halide grains in emulsions may have a regular crystal form, such as a cubic form, an octahedral form or a tetradecahedral form, an irregular crystal form, such as a spherical form or a plate form, a crystal form having a crystal defect, such as a twinning plane, or a composite crystal form thereof.

The silver halide grains may have a wide range of grain size, including from fine grains of about 0.2 μm or smaller to large grains having a projected area diameter reaching about 10 μm. While either a mono-dispersed emulsion or a poly-dispersed emulsion is used, a mono-dispersed emulsion having a grain size of from 0.1 to 1.5 μm with a coefficient of variation of 15% or less is preferred.

The silver halide emulsions can be prepared by the processes described in, e.g., *Research Disclosure* (hereinafter abbreviated as RD), vol. 176, No. 17643 (Dec., 1978), pp. 22–23, "I. Emulsion Preparation and Types"; ibid., No. 18716 (Nov., 1979), p. 648; Glafkides, *Chemic et Phisigue Photographigue*, Paul Montel (1967); G. F. Duffin, *Photographic Emulsion Chemistry, Focal* Press (1966); and V. L. Zelikman et al., *Making and Coating Photographic Emulsion*, Focal Press (1964).

Mono-dispersed emulsions described in U.S. Pat. Nos. 3,574,628 and 3,655,394 and British Patent 1,413,748 are preferably used as well.

Tabular grains having an aspect ratio of about 5 or more are also useful. Such tabular grains can easily be prepared by the processes described in, e.g., Gutoff, *Photographic Science and Engineering*, vol. 14, pp. 248–257 (1970), U.S. Pat. Nos. 4,434,226, 4,414,310, 4,433,048, and 4,439,520, and British Patent 2,112,157.

The silver halide grains may have a uniform crystal structure throughout the individual grains or may be heterogeneous grains including those composed of a core and an outer shell or layers different in halogen compositions, and those having fused thereto silver halide of different halogen composition through epitaxy. Silver halide grains fused with compounds other than silver halides, e.g., silver rhodanide or lead oxide may also be used.

A mixture comprising grains of various crystal forms may be used.

The light-sensitive silver halide emulsion is usually a silver halide emulsion subjected to chemical sensitization. In the chemical sensitization of the light-sensitive silver halide emulsion of the present invention, chalcogen sensitization such as sulfur sensitization, selenium sensitization or tellurium sensitization, noble metal sensitization using gold, platinum or palladium and reduction sensitization, which all are well known for the emulsion used in a normal light-sensitive material, may be conducted individually or in combination (as described in, for example, in JP-A-3-110555, JP-A-5-241267). The chemical sensitization may also be conducted in the presence of a nitrogen-containing heterocyclic compound (see, JP-A-62-253159). Further, an antifoggant as described below may be added after the completion of chemical sensitization. Specifically, methods described in JP-A-5-45833 and JP-A-62-40446 may be used.

The pH at the chemical sensitization is preferably from 5.3 to 10.5, more preferably from 5.5 to 8.5; and the pAg is preferably from 6.0 to 10.5, more preferably from 6.8 to 9.0.

The coated amount of the light-sensitive silver halide emulsion for use in the present invention is from 1 mg/m$^2$ to 10 g/m$^2$ in terms of silver.

In order to impart the light-sensitive silver halide for use in the present invention a color sensitivity to green, red or infrared, the light-sensitive silver halide emulsion is spectrally sensitized with methine dyes or the like. Also, if desired, the blue-sensitive emulsion may be subjected to spectral sensitization in the blue region.

The dye used includes a cyanine dye, a merocyanine dye, a complex cyanine dye, a complex merocyanine dye, a holopolar cyanine dye, a hemicyanine dye, a styryl dye and a hemioxonol dye.

Specific examples thereof include sensitizing dyes described in U.S. Pat. No. 4,617,257, JP-A-59-180550, JP-A-64-13546, JP-A-5-45828 and JP-A-5-45834.

These sensitizing dyes may be used individually or in combination and the combination of sensitizing dyes is frequently used for the purpose of supersensitization or control of the wavelength for spectral sensitivity.

In combination with a sensitizing dye, a dye which itself has no spectral sensitization effect or a compound which absorbs substantially no visible dye, but which is a compound exhibiting supersensitization may be incorporated into the emulsion (those described in, for example, U.S. Pat. No. 3,615,641 and JP-A-63-23145).

The sensitizing dye may be added to the emulsion during, before or after the chemical ripening or may be added before or after the nucleation of a silver halide grain according to U.S. Pat. Nos. 4,183,756 and 4,225,666. The sensitizing dye or supersensitizing dye may be added as a solution of an organic solvent such as methanol, a dispersion in gelatin or a solution of a surface active agent. The addition amount thereof is usually approximately from $10^{-8}$ to $10^{-2}$ mol per mol of silver halide.

Additives which can be used in these steps are described in RD, Nos. 17643, 18716 and 307105 as hereinafter listed. Known additives which can be used in the present invention are also described in the same publications as tabulated below.

| Additive | RD 17643 | RD 18716 | RD 307105 |
|---|---|---|---|
| 1. Chemical Sensitizer | p.23 | p.648, right column (RC) | p.866 |
| 2. Sensitivity Increasing Agent | | p.648, right column (RC) | |
| 3. Spectral Sensitizer, Supersensitizer | pp.23–24 | p.648, RC to p.649, RC | pp.866–868 |
| 4. Brightening Agent | p.24 | p.648, RC | p.868 |
| 5. Antifoggant, Stabilizer | pp.24–25 | p.649, RC | pp.868–870 |
| 6. Light Absorbent, Filter Dye, Ultraviolet Absorbent | pp.25–26 | p.649, RC to p.650, left column (LC) | p.873 |
| 7. Dye Image Stabilizer | p.25 | p.650, LC | p.872 |
| 8. Hardening Agent | p.26 | p.651, LC | pp.874–875 |
| 9. Binder | p.26 | " | pp.873–874 |
| 10. Plasticizer, Lubricant | p.27 | p.650, RC | p.876 |
| 11. Coating Aid, Surface Active Agent | pp.26–27 | " | p.875–876 |
| 12. Antistatic Agent | p.27 | " | pp.876–877 |
| 13. Matting Agent | | | pp.878–879 |

The coupler forming a dye by a coupling reaction with an oxidant of a developing agent, the color developing agent and the mechanism thereof which are applicable to the present invention are described in detail in T. H. James, *The Theory of the Photographic Process,* 4th. edition, p. 291–362 and RD, No. 17643, VII-C to G.

With regard to the coupler for use in the present invention, 2-equivalent color couplers having the coupling site thereof substituted with a releasable group are more preferable than 4-equivalent color couplers having a hydrogen atom at the coupling site because the former can reduce the silver amount for coating.

Examples of the yellow coupler for use in the present invention include oil-protected type acylacetamide couplers. Specific examples thereof are described in U.S. Pat. Nos. 2,407,210, 2,875,057 and 3,265,506. Two-equivalent yellow couplers are preferred as mentioned above. Included in these couplers are yellow couplers of oxygen-release type described in U.S. Pat. Nos. 3,408,194, 3,447,928, 3,935,501 and 4,022,620; and nitrogen-release type yellow couplers described in JP-B-58-10739, U.S. Pat. Nos. 4,401,752 and 4,326,024, RD, No. 18053 (April, 1979), British Patent 1,425,020, and West German Patent OLS Nos. 2,219,917, 2,261,361, 2,329,587, and 2,433,812. In particular, α-pivaloylacetanilide couplers produce dyes having excellent stability especially against light, and α-benzoyl-acetanilide couplers produce dyes having high color density.

Examples of the magenta coupler for use in the present invention include oil-protected type 5-pyrazolone couplers and pyrazoloazole couplers such as pyrazolotriazoles. The 5-pyrazolone couplers are preferably substituted with an arylamino group or an acylamino group at the 3-position thereof in view of the hue or density of a developed color. Typical examples of the 5-pyrazolone couplers are described in U.S. Pat. Nos. 2,311,082, 2,343,703, 2,600,788, 2,908,573, 3,062,653, 3,152,896 and 3,936,015. Releasable groups of 2-equivalent 5-pyrazolone couplers preferably include nitrogen-releasable groups described in U.S. Pat. No. 4,310,619 and arylthio groups described in U.S. Pat. No. 4,351,897. Further, 5-pyrazolone couplers having a ballast group described in European Pat. 73,636 provide high color density.

Examples of the pyrazoloazole couplers for use in the present invention include pyrazolobenzimidazoles described in U.S. Pat. No. 3,369,879, and preferably pyrazolo[5,1-c][1,2,4]-triazoles described in U.S. Pat. No. 3,725,067, pyrazolotetrazoles described in RD, No. 24220 (June, 1984), and pyrazolopyrazoles described in RD, No. 24230 (June, 1984). From the standpoint of reduction in undesired yellow absorption and stability of a developed color against light, imidazo[1,2-b]pyrazoles described in European Patent 119,741 are preferred, and pyrazolo[1,5-b][1,2,4]triazole described in European Patent 119,860 is particularly preferred.

Examples of the cyan couplers for use in the present invention include phenol cyan couplers having an alkyl group having at least two carbon atoms at the m-position of the phenol nucleus described in U.S. Pat. No. 3,772,002, 2,5-diacylamino-substituted phenol couplers described U.S. Pat. Nos. 2,772,162, 3,758,308, 4,126,396, 4,334,011, and 4,327,173, West German Patent OLS No. 3,329,729 and JP-A-59166956 and phenol couplers having a phenylureido group at the 2-position and an acylamino group at the 5-position described in U.S. Pat. Nos. 3,446,622, 4,333,999, 4,451,559 and 4,427,767. Couplers having heat resistance and light resistance described in Japanese Patent Application No. 6-84315 are preferably used in the present invention.

Dye-forming couplers may be in the form of a polymer. Examples thereof are described in U.S. Pat. Nos. 3,451,820, 4,080,211 and 4,367,282, and British Patent 2,102,173.

Couplers capable of releasing a photographically useful residue on coupling are also used to advantage. Examples of suitable DIR couplers which release a development inhibitor are described in RD, No. 17643, Items VII-F, JP-A-57-151944, JP-A-57-154234, JP-A-60-184248, and U.S. Pat. No. 4,248,962.

Examples of suitable couplers which imagewise release a nucleating agent or a development accelerator at the time of development are described in British Patents 2,097,140 and 2,131,188, JP-A-59-157638, and JP-A-59-170840.

Couplers additionally used in the light-sensitive material of the present invention include competing couplers described in U.S. Pat. No. 4,130,427; polyequivalent couplers described in U.S. Pat. Nos. 4,283,472, 4,338,393 and 4,310,618; couplers capable of releasing a DIR redox compound described in JP-A-60-185950; and couplers capable of releasing a dye which restores its color after release described in EP-A-173302.

The coupler capable of correcting colors to provide a substantially black color (coupler for black correction) may form a yellow color, a magenta color or a cyan color, and in addition, may form other colors such as brown, orange, violet and black.

The couplers are introduced into light-sensitive materials by various known dispersion methods.

High-boiling solvents for use in an oil-in-water dispersion method are described in, e.g., U.S. Pat. No. 2,322,027.

With respect to a latex dispersion method, the steps involved, the effects, and specific examples of impregnating latices are described in U.S. Pat. No. 4,199,363 and West German Patent (OLS) Nos. 2,541,274 and 2,541,230.

Binders or protective colloids for use in the, silver halide emulsion, interlayers or protective layers of the light-sensitive material according to the present invention include gelatin and other hydrophilic polymers, with gelatin being advantageous. Examples of the hydrophilic polymers include homo- or copolymers, such as polyvinyl alcohol, polyvinyl alcohol partial acetal, polyvinyl butyral, poly-N-vinylpyrrolidone, polyacrylic acid, polyacrylamide, polyvinylimidazole, polyvinylpyrazole, carrageenan, gum arabic, and cellulose derivatives, such as hydroxyalkyl cellulose, carboxymethyl cellulose, cellulose sulfate, cellulose acetate hydrogen phthalate, and sodium alginate.

Graft polymers of gelatin and other high polymers are also effective. For example, gelatin to which a homo- or copolymer of a vinyl monomer, such as acrylic acid, (meth)-acrylic acid or a derivative thereof (e.g., ester, amide), acrylonitrile or styrene, is grafted can be used. In particular, graft polymers of gelatin and a polymer which is compatible with gelatin to some extent, such as (meth)acrylic acid, (meth)acrylamide or a hydroxyalkyl methacrylate, are preferred. Examples of these graft copolymers are described in U.S. Pat. Nos. 2,763,625, 2,831,767 and 2,956,884, and JP-A-5665133.

Typical synthetic hydrophilic high polymers which can be used in the present invention are described in, e.g., West German Patent Publication (OLS) 2,312,708, U.S. Pat. No. 3,620,751 and 3,879,205, and JP-B-43-7561.

The above-mentioned hydrophilic polymers may be used alone or in combination of two or more thereof.

Examples of gelatin for use in the present invention include alkali-processed gelatin, acid-processed gelatin, enzyme-processed gelatin, and a mixture thereof. Gelatin derivatives obtained by reacting gelatin with various compounds, such as acid halide, acid anhydride, isocyanate compound, bromoacetic acid, alkanesultonic acid, vinylsulfonamide compound, maleinimide compound, polyalkylene oxide, and epoxy compound are also useful. Specific examples of the gelatin derivatives are given in U.S. Pat. Nos. 2,614,928, 3,132,945, 3,186,846 and 3,312,553, British Patents 861,414, 1,033,189 and 1,005,784, and JP-B-42-26845.

The support for use in the present invention is preferably a light-transmitting substrate. Additionally, the light-sensitive material according to the present invention may be produced by coating a silver halide emulsion layer on another support and transfer-adhering the emulsion side thereof on a light-transmitting substrate as described in Japanese Patent Application No. 6-1363. In this case, the support may be transparent or may be coated with, e.g., carbon black on the back surface thereof.

Examples of the material constituting the light-transmitting substrate for use in the present invention include those made of polyethylene terephthalate, polybutylene terephthalate, polyethylene naphthalate, polystyrene, polycarbonate, polyether sulfone, cellulose acetate, polyarylate, soda-lime glass, borosilicate glass, and quartz.

The surface of the substrate may be subjected to undercoating processing, if necessary. Further, surface processing, such as glow discharge, corona discharge, and ultraviolet (UV) irradiation, may be conducted.

The light-transmitting substrate may be used in the form of, for example, a plate, a sheet, or a film. The thickness of the substrate can be selected appropriately according to the purpose and material and is usually from 0.01 to 10 mm. For example, a glass substrate usually has a thickness of from 0.3 to 3 mm.

The light-sensitive materials may be development processed to prepare a micro color filter according to usual methods as described in RD, No. 17643, pp. 28–29 and ibid., 651, left to right columns. They may be subjected to prehardening processing or post hardening processing.

Examples of the pattern exposure system for use in the present invention include a planar exposure system and a scanning exposure system. Examples of the scanning system include a line (slit) scanning system and a point scanning system using, e.g., a leaser beam.

Examples of a light source include tungsten lamp, halogen lamp, fluorescent lamp (e.g., three wavelengths type fluorescent lamp), laser lamp, and light emitting diode. Preferred are halogen lamp, fluorescent lamp and laser lamp.

The color filter produced by the process of the present invention may have a protective layer (overcoat layer) having heat resistance, water resistance and high specific conductivity resistance as an outermost layer. Examples of the resins are described in U.S. Pat. Nos. 4,698,295 and 4,668,601, EP-A-179636, EP-A-556810, JP-A-3-163416, JP-A-3-188153, JP-A-578443, JP-A-1-276101, JP-A-60-216307, and JP-A-63-218771.

A transparent electrode, such as an indium-tin oxide layer (ITO), may be provided on the color filter by deposition, for example, by vacuum evaporation or sputtering.

Furthermore, an orientation layer such as polyimide resin may be provided thereon.

Moreover, a polarizer or a phase retarder may be provided on the light-transmitting substrate of the color filter on its side opposite to the emulsion layer.

A color liquid crystal display (hereinafter abbreviated as LCD) using the color filter according to the present invention will be described below.

Figure 6:
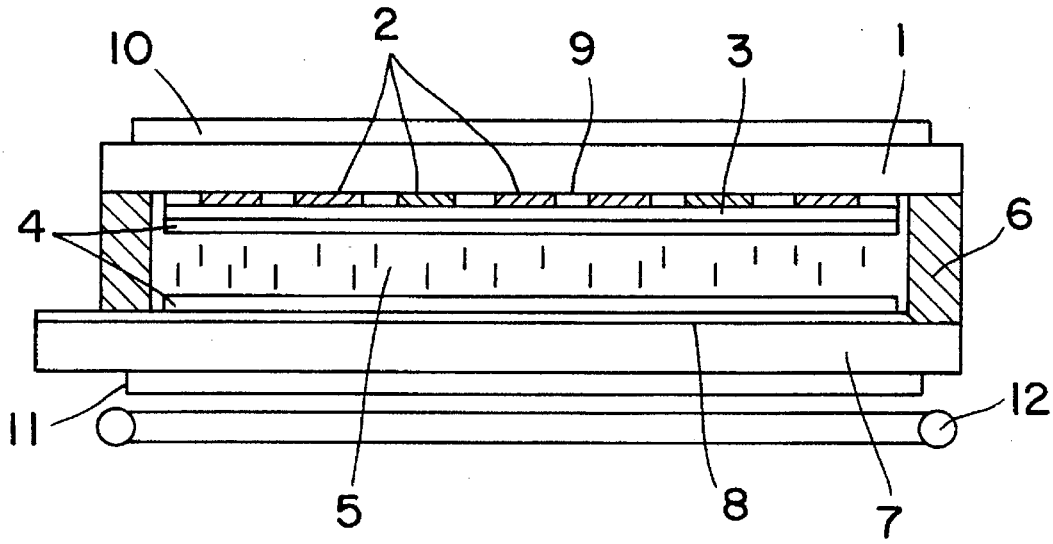
FIG. 6 shows the example of a color liquid crystal filter using a color filter according to the present invention.

In FIG. 6 is shown a schematic cross section of an example of LCD. Color filter 2, which is formed on glass substrate 1 according to the Example, is covered with a protective film (not shown) made of the above-mentioned resin. Transparent electrode, e.g., an indium-tin oxide (ITO) electrode, is formed on the protective film by means of a vacuum film-forming apparatus. Transparent electrode 3 is usually provided on the entire surface of the color filter in the case of active matrix-driven LCD using a three-terminal switching array like TFT or in the stripe form in the case of simple matrix-driven LCD or active matrix-driven LCD using a two-terminal switching array like MIM. On transparent electrode 3 is provided orientation layer 4 comprising polyimide, etc. for alignment of liquid crystal molecules.

The ITO-glass substrate having color filter 3 is assembled with another glass substrate 7 having formed thereon transparent electrode (e.g., an ITO electrode) and layer 4 in this order via spacers (not shown) and sealing material 6 with both alignment layers facing to each other. In the case of active matrix-driven LCD using a three-terminal switching array like TFT, transparent electrode 8 forms pixels connected with TFT elements. In the case of simple matrix-driven LCD, such as STN mode LCD, transparent electrode 8 usually has the form of stripes crossing the stripes of transparent electrode 3 on the other side.

Black matrix 9 is usually formed among R, G, and B pixels to improve contrast or color purity. Black matrix 9 can be formed simultaneously with the formation of R, G, and B pixels, or a chromium film or a carbon film may be formed separately. Polarizers 10 and 11 are placed on the back side of glass substrates 1 and 2, respectively. If desired, a phase compensator (not shown) may be provided between each glass substrate and the polarizer.

Because the LCD using a color filter has a low light transmission, back light 12 is usually placed as a light source which matches the color filter in color reproduction.

A plastic film having a gas barrier layer or a hard coating layer may be used in place of the above-described glass substrate as a light-transmitting substrate.

For the details of color LCD and methods for producing color LCD, reference can be made to Matsumoto Sho-ichi and Tsunoda Nagayoshi, *Ekisho no kiso to o-yo (Basis and Application of Liquid Crystal*, Kogyo Chosakai Publishing Co., Ltd. (1991), Nikkei Microdevice (ed.), *Flat Panel Display* 1994, Nikkei Business Publications, Inc. (1993), and JP-A-1-114820.

The present invention will now be illustrated in greater detail with reference to the following examples, but it should be understood that the present invention is not construed as being limited thereto. All percents are by weight unless otherwise indicated.

EXAMPLE 1

As described in the example of JP-A-3-293348, a 100 μm-thick polyethylene terephthalate support having coated thereon as a back layer carbon black dispersed in polyvinyl chloride was subbed with gelatin and thereon from first to ninth layers each having the following construction were simultaneously coated in a multilayer coating method to prepare Color Light-Sensitive Material 1A. The components and coated amounts (unit: $g/m^2$) are shown below. With respect to silver halide and colloidal silver emulsion, the coated amount is shown in terms of silver. The silver halide emulsion in each layer was a negative silver chlorobromide.

| | |
|---|---|
| First Layer (Peeling Layer) | |
| Hydroxyethyl cellulose | 0.72 |
| Terminal alkyl-modified polyvinyl alcohol (saponification degree: 98 mol %, polymerization degree: 300) | 0.15 |
| Second Layer (Gelatin Adjacent Layer) | |
| Gelatin | 0.50 |
| Third Layer (Red-Sensitive Layer) | |
| Silver chlorobromide spectrally sensitized with Red Sensitizing Dye (ExS-1) (Br: 25%, 0.2 μm) | 0.60 |
| Gelatin | 1.62 |
| Yellow Coupler (ExY-1) | 0.52 |
| Magenta Coupler (ExM-1) | 0.20 |
| Dye Image Stabilizer (Cpd-4) | 0.22 |
| Stain Inhibitor (Cpd-5) | 0.01 |
| Stain Inhibitor (Cpd-6) | 0.02 |
| Stain Inhibitor (Cpd-7) | 0.06 |
| Discoloration Inhibitor (Cpd-12) | 0.07 |
| Polymer (Cpd-13) | 0.06 |
| Dye Image Stabilizer (Cpd-18) | 0.03 |
| Compound (Cpd-20) | 0.01 |
| High Boiling Point Solvent (Solv-2) | 0.53 |
| High Boiling Point Solvent (Solv-3) | 0.14 |
| High Boiling Point Solvent (Solv-4) | 0.18 |
| Fourth Layer (Interlayer) | |
| Gelatin | 1.21 |

-continued

| | |
|---|---|
| Discoloration Inhibitor (Cpd-3) | 0.08 |
| High Boiling Point Solvent (Solv-1) | 0.05 |
| High Boiling Point Solvent (Solv-2) | 0.13 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Polymer (Cpd-11) | 0.05 |
| Yellow Dye (YF-1) | 0.16 |
| Fifth Layer (Green-Sensitive Layer) | |
| Silver chlorobromide spectrally sensitized with Green Sensitizing Dyes (ExS-2) and (ExS-3) (Br: 30%, 0.2 μm) | 0.40 |
| Gelatin | 1.53 |
| Cyan Coupler (ExC-1) | 0.45 |
| Yellow Coupler (ExY-1) | 0.52 |
| Dye Image Stabilizer (Cpd-1) | 0.03 |
| Dye Image Stabilizer (Cpd-2) | 0.07 |
| Stain Inhibitor (Cpd-7) | 0.03 |
| Discoloration Inhibitor (Cpd-12) | 0.07 |
| Polymer (Cpd-13) | 0.06 |
| Dye Image Stabilizer (Cpd-18) | 0.01 |
| High Boiling Point Solvent (Solv-1) | 0.23 |
| High Boiling Point Solvent (Solv-4) | 0.18 |
| Sixth Layer (Interlayer) | |
| Gelatin | 1.16 |
| Color Mixing Inhibitor (Cpd-3) | 0.08 |
| High Boiling Point Solvent (Solv-1) | 0.05 |
| High Boiling Point Solvent (Solv-2) | 0.13 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Polymer (Cpd-11) | 0.05 |
| Seventh Layer (Blue-Sensitive Layer) | |
| Silver chlorobromide spectrally sensitized with Blue Sensitizing Dye (ExS-4) (Br: 80%, 0.5 μm) | 0.54 |
| Antifoggant (Cpd-15) | 0.03 |
| Gelatin | 1.00 |

-continued

| | |
|---|---|
| Cyan Coupler (ExC-1) | 0.50 |
| Magenta Coupler (ExM-1) | 0.10 |
| Dye Image Stabilizer (Cpd-1) | 0.03 |
| Dye Image Stabilizer (Cpd-2) | 0.08 |
| Dye Image Stabilizer (Cpd-4) | 0.12 |
| Stain Inhibitor (Cpd-5) | 0.01 |
| Stain Inhibitor (Cpd-6) | 0.01 |
| Stain Inhibitor (Cpd-7) | 0.02 |
| Dye Image Stabilizer (Cpd-18) | 0.01 |
| High Boiling Point Solvent (Solv-1) | 0.25 |
| High Boiling Point Solvent (Solv-2) | 0.28 |
| High Boiling Point Solvent (Solv-3) | 0.07 |
| Eighth Layer (Irradiation-Preventing Dye Layer) | |
| Gelatin | 0.51 |
| Irradiation-Preventing Dye (Dye-1 and Dye-2 at a molar ratio of 1:3) | 0.02 |
| Ninth Layer (Protective Layer) | |
| Gelatin | 1.43 |
| Colloidal silver emulsion (average grain size: 0.02 μm) | 0.20 |
| Polymer (Cpd-19) | 0.29 |
| Amphoteric Surface Active Agent (Cpd-14) | 0.06 |
| Hardening Agent (H-1) | 0.12 |

To each silver halide emulsion layer, Cpd-21 was added in an amount of $4\times10^{-6}$ mol for the blue-sensitive layer, $3\times10^{-5}$ mol for the green-sensitive layer and $1\times10^{-5}$ mol for the red-sensitive layer, per mol of silver halide.

Also, Cpd-16 was added to the blue-sensitive and green-sensitive layers in an amount of $1.2\times10^{-2}$ mol for the blue-sensitive layer and $1.1\times10^{-2}$ mol for the green-sensitive layer, per mol of silver halide.

Further, sodium dodecylbenzenesulfonate as an emulsion dispersion aid, ethyl acetate as an auxiliary solvent, Cpd-17 as a coating aid and potassium polystyrenesulfonate as a thickener were added to each layer.

ExS-1

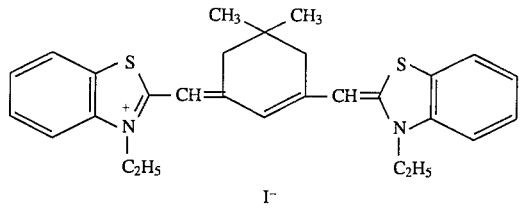

ExS-2

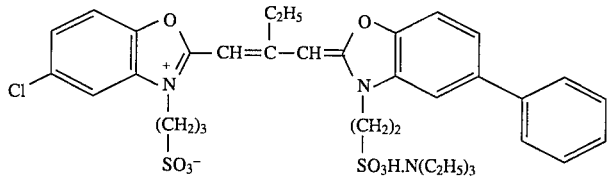

ExS-3

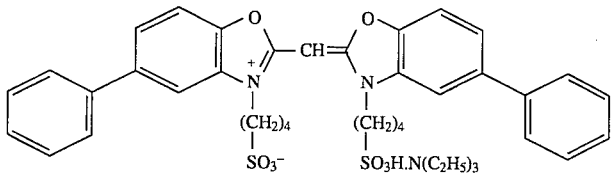

-continued
ExS-4
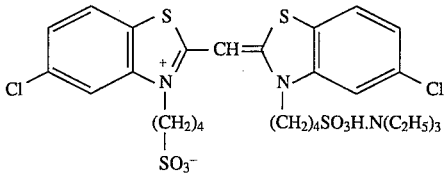
ExC-1
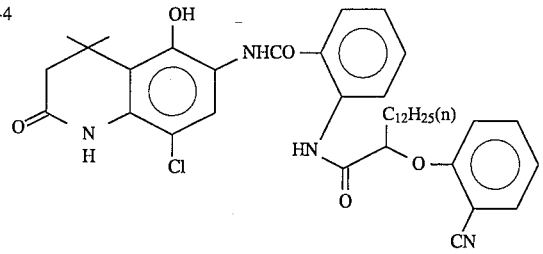
ExM-1
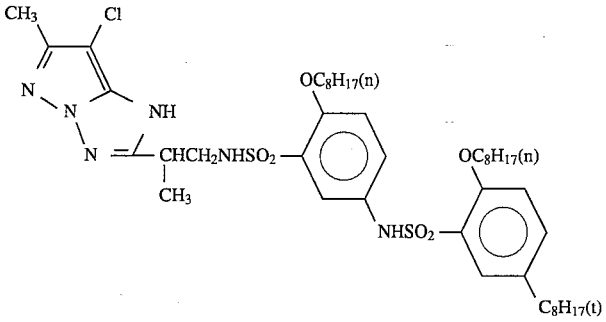
ExY-1
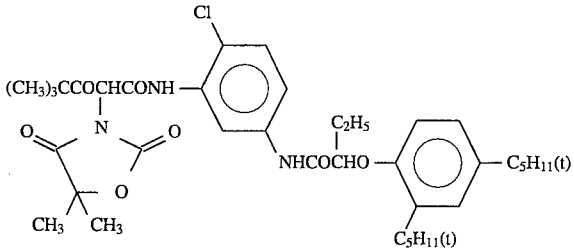
Cpd-1
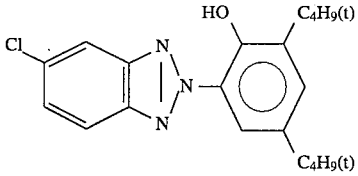
Cpd-2
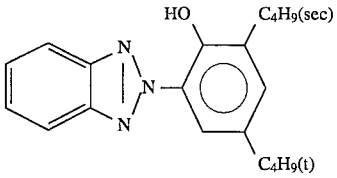
Cpd-3
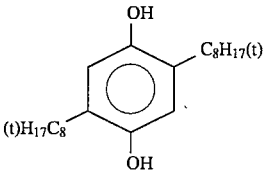
Cpd-4
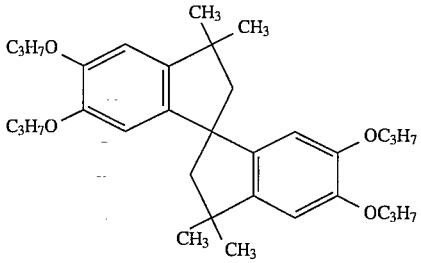
Cpd-5
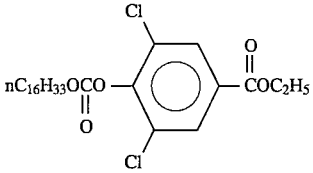
Cpd-6
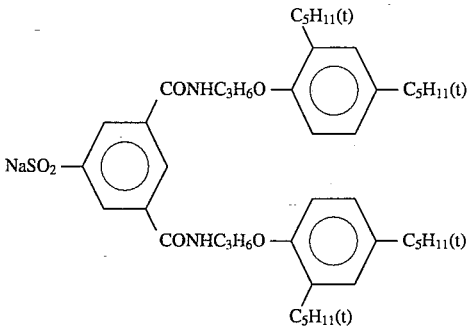

-continued
Cpd-7
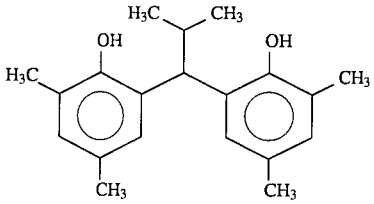
Cpd-8
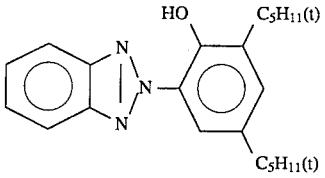
Cpd-9
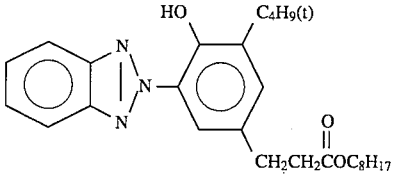
Cpd-10
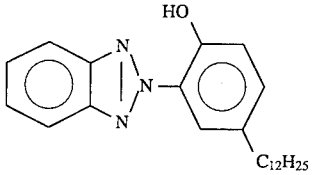
Cpd-11
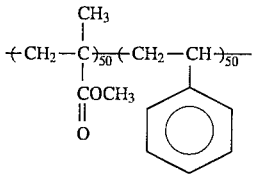
Cpd-12
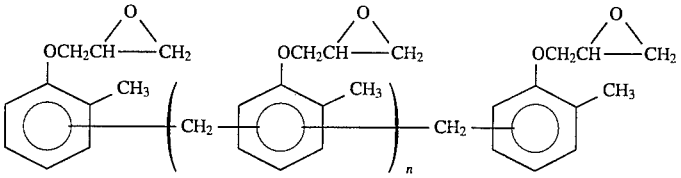
n = 7 ~ 8
Cpd-13
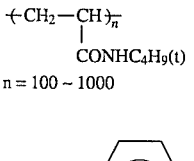
n = 100 ~ 1000
Cpd-14
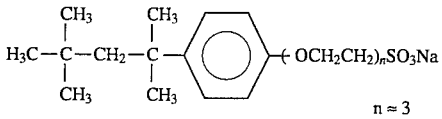
n ≈ 3
Cpd-15
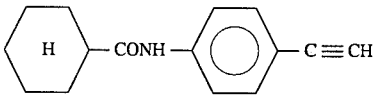
Cpd-16
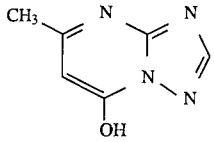
Cpd-17
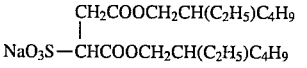
Cpd-18
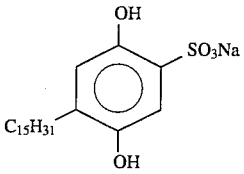
Cpd-19
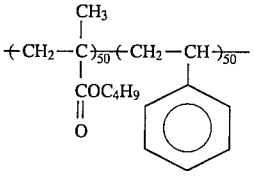

-continued

Cpd-20

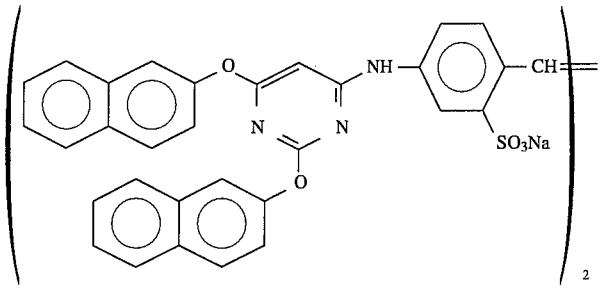

Cpd-21

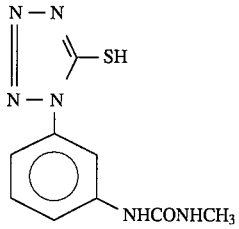

$CH_2{=}CHSO_2CH_2SO_2CH{=}CH_2$ H-1

Solv-1

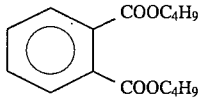

Solv-2

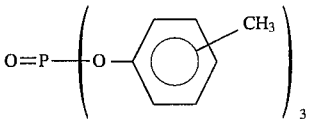

$O{=}P{\leftarrow}O{-}C_8H_{17}(EH))_3$ Solv-3

$C_8H_{17}CHCH(CH_2)_7COOC_8H_{17}$ Solv-4

YF-1

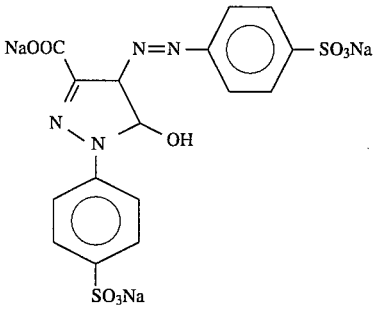

Dye-1

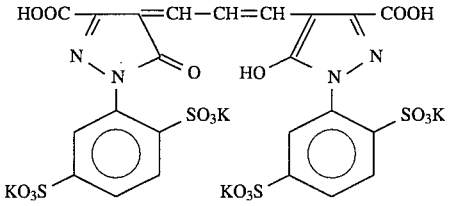

Dye-2

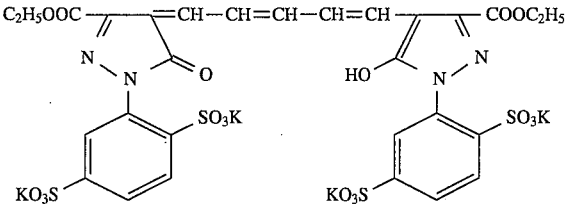

A transparent borosilicate glass (30 cm×30 cm) having a thickness of 1.1 mm was used as a light transmissive substrate and thereon gelatin and colloidal silica (having an average particle size of from 7 to 9 mμ) mixed at a weight ratio of 1:3 and added by saponin as a surface active agent were coated. The coated thickness was 0.2 μm in terms of a dry thickness.

The coated surface of the light transmissive substrate and the protective layer of the color light-sensitive material prepared above were put into close contact and then passed through a laminator of which temperature was set to render the temperature on the surface in close contact about 130° C., at a linear velocity of 0.45 m/minute. After cooling nearly to room temperature, the support of the light-sensitive material was peeled off from the emulsion surface. The emulsion surface uniformly adhered to the substrate and no white spot was observed.

The thus-prepared substrate having an emulsion layer was exposed to a tungsten light from the emulsion surface side while superposing thereon a mask for color filter having a mosaic of a blue part, a green part and a red part in the transparent background. The exposed substrate was developed through the following steps. This operation was conducted once and a color filter colored to three colors of B, G and R and to black was prepared.

| Processing Step | Temperature (°C.) | Time |
|---|---|---|
| Film hardening | 38 | 3 min. |
| Water washing-1 | 35 | 1 min. |
| Color development | 38 | 2 min. 30 sec. |
| Bleach-fixing | 38 | 1 min. |
| Water washing-2 | 35 | 40 sec. |

-continued

| | | |
|---|---|---|
| Water washing-3 | 35 | 40 sec. |
| Drying | 60 | 2 min. |

Each processing solution had the following composition.

| | |
|---|---|
| Hardening Solution | |
| Sodium sulfate (anhydrous) | 160.0 g |
| Sodium carbonate (anhydrous) | 4.6 g |
| Formalin (37%) | 20.0 ml |
| Water to make | 1 liter |
| pH (25° C.) | 10.0 |
| Color Developer | |
| D-Sorbitol | 0.15 g |
| Sodium naphthalenesulfonate.formalin condensate | 0.15 g |
| Pentasodium nitrilotris(methylene-phosphate) | 1.80 g |
| Diethylenetriaminepentaacetic acid | 0.50 g |
| 1-Hydroxyethylidene-1,1-diphosphonic acid | 0.15 g |
| Diethylene glycol | 12.0 ml |
| Benzyl alcohol | 13.5 ml |
| Potassium bromide | 0.70 g |
| Benzotriazole | 0.003 g |
| Sodium sulfite | 2.40 g |
| Disodium-N,N-bis(sulfonate ethyl)hydroxyl-amine | 8.0 g |
| Triethanolamine | 6.00 g |
| N-Ethyl-N-(β-methanesulfonamidoethyl)-3-methyl-4-aminoaniline.3/2 sulfuric acid. monohydrate | 6.00 g |
| Potassium carbonate | 30.0 g |
| Water to make | 1 liter |
| pH (25° C.) | 10.6 |
| Bleach-Fixing Solution | |
| Ethylenediaminetetraacetic acid | 5.0 g |
| Ferric ammonium ethylenediaminetetra-acetate | 55.0 g |
| Ammonium thiosulfate (750 g/liter) | 160 ml |
| Ammonium sulfite | 40.0 g |
| Ammonium nitrate | 10.0 g |
| Water to make | 1 liter |
| pH (25° C.) | 6.0 |
| Washing Water | |
| Deionized water having an electroconductivity of 5 μS or less | |

The color development was carried out with stirring the developer by air bubbles of $N_2$ gas.

The color filter obtained was measured on the transmittance and showed good results such that the blue part was 70% (445 nm), the green part was 65% (530 nm) and -she red part was 90% (630 to 700 nm). However, on measuring the transmission density of the black part, the cyan was 2.9, the magenta was 2.0 and the yellow was 2.2 and thus, although the cyan density was almost satisfactory, the magenta and yellow densities were insufficient. In order to compensate this defect, the following interlayer and infra-red-sensitive layer were inserted in this order between the seventh layer (blue-sensitive layer) and the eighth layer (irradiation preventing dye layer) of Light-Sensitive Layer 1A and this sample was designated as Light-Sensitive Layer 1B.

| | |
|---|---|
| Interlayer | |
| Gelatin | 0.90 |
| Color Mixing Inhibitor (Cpd-3) | 0.08 |
| High Boiling Point Solvent (Solv-1) | 0.05 |
| High Boiling Point Solvent (Solv-2) | 0.13 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Polymer (Cpd-11) | 0.05 |
| Infrared-Sensitive Layer | |
| Silver chlorobromide spectrally sensitized with Infrared Sensitizing Dye (ExS-5) (Br: 80%, 0.4 μm) | 0.40 |
| Gelatin | 1.00 |
| Yellow Coupler (ExY-1) | 0.37 |
| Magenta Coupler (ExM-1) | 0.15 |
| Dye Image Stabilizer (Cpd-4) | 0.10 |
| Stain Inhibitor (Cpd-7) | 0.03 |
| Discoloration Inhibitor (Cpd-12) | 0.04 |
| Polymer (Cpd-13) | 0.04 |
| Compound (Cpd-20) | 0.01 |
| High Boiling Point Solvent (Solv-2) | 0.25 |
| High Boiling Point Solvent (Solv-3) | 0.10 |
| High Boiling Point Solvent (Solv-4) | 0.13 |

ExS-5

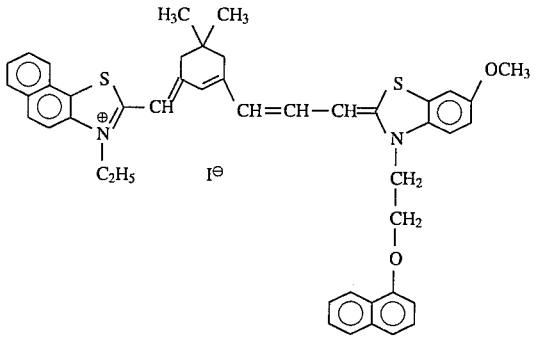

The emulsion layer of Light-Sensitive Material 1B was transferred onto the glass substrate and then the emulsion surface was exposed to a tungsten light through a mask for color filter having a transparent background capable of transmitting B, G, R and an infrared light up to 900 nm. The processing was conducted in the same manner as for Light-Sensitive Martial 1A and as a result, the transmittance in the blue part, the green part and the red part was almost on the same level and the transmission density on the black part was from 2.9 to 3.0 for all of cyan, magenta and yellow, thus a substantially black color was obtained.

EXAMPLE 2

Color Light-Sensitive Material 2A having the following constitution was prepared using the same support, silver halide emulsions, couplers and additives as Light-Sensitive Material 1A.

| | |
|---|---|
| First Layer (Peeling Layer) | |
| Hydroxyethyl cellulose | 0.72 |
| Terminal alkyl-modified polyvinyl alcohol (saponification degree: 98 mol %, polymerization degree: 300) | 0.15 |
| Second Layer (Gelatin Adjacent Layer) | |
| Gelatin | 0.50 |
| Third Layer (First Red-Sensitive Layer) | |
| Silver chlorobromide spectrally sensitized with Red Sensitizing Dye (ExS-1) (Br: 25%, 0.2 μm) | 0.30 |
| Gelatin | 0.78 |
| Magenta Coupler (ExM-1) | 0.20 |
| Dye Image Stabilizer (Cpd-4) | 0.22 |
| Stain Inhibitor (Cpd-5) | 0.01 |
| Stain Inhibitor (Cpd-6) | 0.02 |

-continued

| | |
|---|---|
| Stain Inhibitor (Cpd-7) | 0.03 |
| Dye Image Stabilizer (Cpd-18) | 0.01 |
| Compound (Cpd-20) | 0.01 |
| High Boiling Point Solvent (Solv-2) | 0.53 |
| High Boiling Point Solvent (Solv-3) | 0.14 |
| Fourth Layer (Second Red-Sensitive Layer) | |
| Silver chlorobromide spectrally sensitized with Red Sensitizing Dye (ExS-1) (Br: 25%, 0.2 μm) | 0.30 |
| Gelatin | 0.84 |
| Yellow Coupler (ExY-1) | 0.52 |
| Stain Inhibitor (Cpd-7) | 0.03 |
| Discoloration Inhibitor (Cpd-12) | 0.07 |
| Polymer (Cpd-13) | 0.06 |
| Dye Image Stabilizer (Cpd-18) | 0.03 |
| Compound (Cpd-20) | 0.01 |
| High Boiling Point Solvent (Solv-4) | 0.08 |
| Fifth Layer (First Green-Sensitive Layer) | |
| Silver chlorobromide spectrally sensitized with Green Sensitizing Dyes (ExS-2) and (ExS-3) (Br: 30%, 0.2 μm) | 0.30 |
| Gelatin | 0.80 |
| Yellow Coupler (ExY-1) | 0.52 |
| Stain Inhibitor (Cpd-7) | 0.03 |
| Discoloration Inhibitor (Cpd-12) | 0.07 |
| Polymer (Cpd-13) | 0.06 |
| Dye Image Stabilizer (Cpd-18) | 0.01 |
| High Boiling Point Solvent (Solv-4) | 0.18 |
| Sixth Layer (Second Green-Sensitive Layer) | |
| Silver chlorobromide spectrally sensitized with Green Sensitizing Dyes (ExS-2) and (ExS-3) (Br: 30%, 0.2 μm) | 0.20 |
| Gelatin | 0.73 |
| Cyan Coupler (ExC-1) | 0.45 |
| Dye Image Stabilizer (Cpd-1) | 0.03 |
| Dye Image Stabilizer (Cpd-2) | 0.07 |
| Dye Image Stabilizer (Cpd-18) | 0.01 |
| High Boiling Point Solvent (Solv-1) | 0.23 |
| Seventh Layer (First Blue-Sensitive Layer) | |
| Silver chlorobromide spectrally sensitized with Blue Sensitizing Dye (ExS-4) (Br: 80%, 0.5 μm) | 0.36 |
| Antifoggant (Cpd-15) | 0.02 |
| Gelatin | 0.68 |
| Cyan Coupler (ExC-1) | 0.50 |
| Dye Image Stabilizer (Cpd-1) | 0.03 |
| Dye Image Stabilizer (Cpd-2) | 0.08 |
| Dye Image Stabilizer (Cpd-18) | 0.01 |
| High Boiling Point Solvent (Solv-1) | 0.25 |
| Eighth Layer (Second Blue-Sensitive Layer) | |
| Silver chlorobromide spectrally sensitized with Blue Sensitizing Dye (ExS-4) (Br: 80%, 0.5 μm) | 0.18 |
| Antifoggant (Cpd-15) | 0.01 |
| Gelatin | 0.32 |
| Magenta Coupler (ExM-1) | 0.10 |
| Dye Image Stabilizer (Cpd-4) | 0.12 |
| Stain Inhibitor (Cpd-5) | 0.01 |
| Stain Inhibitor (Cpd-6) | 0.01 |
| Stain Inhibitor (Cpd-7) | 0.02 |
| Dye Image Stabilizer (Cpd-18) | 0.01 |
| High Boiling Point Solvent (Solv-2) | 0.28 |
| High Boiling Point Solvent (Solv-3) | 0.07 |
| Ninth Layer (Irradiation-Preventing Dye Layer) | |
| Gelatin | 0.51 |
| Irradiation-Preventing Dye (Dye-1 and Dye-2 at a molar ratio of 1:3) | 0.02 |
| Tenth Layer (Protective Layer) | |
| Gelatin | 1.43 |
| Colloidal silver emulsion (average grain size: 0.02 μm) | 0.20 |
| Polymer (Cpd-19) | 0.29 |
| Amphoteric Surface Active Agent (Cpd-14) | 0.06 |
| Hardening Agent (H-1) | 0.12 |

Light-Sensitive Material 2B was prepared by inserting an interlayer and an infrared-sensitive layer having the same composition as in Example 1 in this order between the eighth layer (second blue-sensitive layer) and the ninth layer (irradiation-preventing dye layer).

Light-Sensitive Materials 2A and 2B were processed in the same manner as in Example 1 and as a result, the transmittance was high in any of the blue part, the green part and the red part. The density in the black part was insufficient with respect to magenta and yellow in Light-Sensitive Material 2A but it was about 3 and a substantially black color was obtained in Light-Sensitive Material 2B.

EXAMPLE 3

PEN-1A described in Example 1 of *JIII Journal of Technical Disclosure* No. 94-6023 was used and subjected to surface treatment in the same manner and after subbing with gelatin, from the first to ninth layers each having the constitution described below were coated thereon simultaneously in a multilayered coating method to prepare Color Light-Sensitive Material 3A. The halogen emulsions, couplers and additives used were the same as used in Example 1.

| | |
|---|---|
| First Layer (Antihalation Layer) | |
| Gelatin | 0.70 |
| Colloidal silver emulsion (average particle size: 0.02 μm) | 0.20 |
| Second Layer (Gelatin Layer) | |
| Gelatin | 0.50 |
| Third Layer (Red-Sensitive Layer) | |
| Silver chlorobromide spectrally sensitized with Red Sensitizing Dye (ExS-1) (Br: 25%, 0.2 μm) | 0.32 |
| Gelatin | 1.00 |
| Cyan Coupler (ExC-1) | 0.42 |
| Discoloration Inhibitor (Cpd-1) | 0.03 |
| Discoloration Inhibitor (Cpd-2) | 0.06 |
| High Boiling Point Solvent (Solv-1) | 0.21 |
| Color Mixing Inhibitor (Cpd-18) | 0.02 |
| Compound (Cpd-20) | 0.01 |
| Fourth Layer (Interlayer) | |
| Gelatin | 0.53 |
| Discoloration Inhibitor (Cpd-3) | 0.08 |
| High Boiling Point Solvent (Solv-1) | 0.05 |
| High Boiling Point Solvent (Solv-2) | 0.13 |
| Irradiation-preventing Dye (Dye-1 and Dye-2 at a molar ratio of 1:3) | 0.02 |
| Fifth Layer (Green-Sensitive Layer) | |
| Silver chlorobromide spectrally sensitized with Green Sensitizing Dyes (ExS-2) and (ExS-3) (Br: 30%, 0.2 μm) | 0.28 |
| Gelatin | 1.21 |
| Magenta Coupler (ExM-1) | 0.21 |
| Discoloration Inhibitor (Cpd-4) | 0.23 |
| Stain Inhibitor (Cpd-5) | 0.01 |
| Stain Inhibitor (Cpd-6) | 0.02 |
| Discoloration Inhibitor (Cpd-7) | 0.03 |
| High Boiling Point Solvent (Solv-2) | 0.49 |
| High Boiling Point Solvent (Solv-3) | 0.13 |
| Sixth Layer (Interlayer) | |
| Gelatin | 0.63 |
| Discoloration Inhibitor (Cpd-3) | 0.08 |
| High Boiling Point Solvent (Solv-1) | 0.05 |
| High Boiling Point Solvent (Solv-2) | 0.12 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Polymer (Cpd-11) | 0.05 |

-continued

| | |
|---|---|
| Yellow Dye (YF-1) | 0.15 |
| Seventh Layer (Blue-Sensitive Layer) | |
| Silver chlorobromide spectrally sensitized with Blue Sensitizing Dye (ExS-4) (Br: 80%, 0.5 μm) | 0.37 |
| Gelatin | 1.14 |
| Yellow Coupler (ExY-1) | 0.55 |
| Discoloration Inhibitor (Cpd-12) | 0.07 |
| Stain Inhibitor (Cpd-7) | 0.03 |
| Polymer (Cpd-13) | 0.06 |
| High Boiling Point Solvent (Solv-4) | 0.18 |
| Color Mixing Inhibitor (Cpd-18) | 0.01 |
| Eighth Layer (Ultraviolet Absorbing Layer) | |
| Gelatin | 0.30 |
| High Boiling Point Solvent (Solv-2) | 0.12 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Ninth Layer (Protective Layer) | |
| Gelatin | 0.70 |
| Surface Active Agent (Cpd-14) | 0.06 |
| Hardening Agent (H-1) | 0.15 |

Then, an infrared-sensitive layer and an interlayer each having the following composition were inserted in this order between the second layer (gelatin layer) and the third layer (red-sensitive layer) to prepare Light-Sensitive Material 1B.

| | |
|---|---|
| Infrared-Sensitive Layer | |
| Silver chlorobromide spectrally sensitized with Infrared Sensitizing Dye (ExS-5) (Br: 80%, 0.4 μm) | 0.40 |
| Gelatin | 1.80 |
| Yellow Coupler (ExY-1) | 0.85 |
| Magenta Coupler (ExM-1) | 0.26 |
| Cyan Coupler (ExC-1) | 0.44 |
| Dye Image Stabilizer (Cpd-4) | 0.11 |
| Stain Inhibitor (Cpd-7) | 0.04 |
| Discoloration Inhibitor (Cpd-12) | 0.07 |
| Polymer (Cpd-13) | 0.12 |
| Compound (Cpd-20) | 0.01 |
| High Boiling Point Solvent (Solv-2) | 0.50 |
| High Boiling Point Solvent (Solv-3) | 0.16 |
| High Boiling Point Solvent (Solv-4) | 0.34 |
| Interlayer | |
| Gelatin | 0.65 |
| Color Mixing Inhibitor (Cpd-3) | 0.08 |
| High Boiling Point Solvent (Solv-1) | 0.05 |
| High Boiling Point Solvent (Solv-2) | 0.13 |
| Ultraviolet Absorbent (Cpd-1) | 0.01 |
| Ultraviolet Absorbent (Cpd-8) | 0.02 |
| Ultraviolet Absorbent (Cpd-9) | 0.06 |
| Ultraviolet Absorbent (Cpd-10) | 0.04 |
| Polymer (Cpd-11) | 0.05 |

Light-Sensitive Materials 3A and 3B were exposed to a tungsten light through the same mask for color filter as used in Example 1 and then precessed in the same manner as in Example 1 to provide a pattern having a yellow part, a magenta part, a cyan part and a black part. Both of the light-sensitive materials showed excellent transmittance in the yellow, magenta and cyan parts. The density of the black part was low and insufficient in Light-Sensitive Material 3A but it was satisfactory and a substantially black color was obtained in Light-Sensitive Material 3B.

A color filter having a high transmittance in the blue, green and red parts or the yellow, magenta and cyan parts and a density of the black part of 2.5 or more, thus giving a substantially black color, can be simply obtained by providing, in addition to usual silver halide emulsion layers having three color sensitivities corresponding to the blue, green and red parts or the yellow, magenta and cyan parts, respectively, a silver halide emulsion layer having the fourth color sensitivity and containing a coupler for correcting the black color.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material comprising a support having thereon at least four silver halide emulsion layers each having a different color sensitivity, wherein three of the four silver halide emulsion layers are a red color forming-layer containing a yellow coupler and a magenta coupler;

a green color forming-layer containing a yellow coupler and a cyan coupler; and a blue color forming-layer containing a magenta coupler and a cyan coupler, and wherein one of the at least four silver halide emulsion layers contains one or more couplers capable of correcting colors so as to provide a black color having a transmission density of 2.5 or more when all couplers on the support react, and wherein the order of the at least four silver halide emulsion layers is freely selected.

2. A color filter comprising blue, green, red and black parts prepared by subjecting the silver halide light-sensitive material according to claim 1 to pattern exposure, color development, bleach-fixing and water washing.

3. A method of preparing a color filter, comprising subjecting the silver halide light-sensitive material according to claim 1 to pattern exposure, color development, bleach-fixing and water washing.

4. A silver halide light-sensitive material comprising a support having thereon at least four silver halide emulsion layers each having a different color sensitivity, wherein three of the four silver halide emulsion layers are a red color forming-layer having a unit layer containing a yellow coupler and a unit layer containing a magenta coupler;

a green color forming-layer having a unit layer containing a yellow coupler and a unit layer containing a cyan coupler; and a blue color forming-layer having a unit layer containing a magenta coupler and a unit layer containing a cyan coupler, and wherein one of the at least four silver halide emulsion layers contains at least one coupler capable of correcting colors so as to provide a black color having a transmission density of 2.5 or more when all couplers on the support react, and wherein the order of the at least four silver halide emulsion layers is freely selected.

5. A silver halide light-sensitive material according to claim 4, wherein the red, green and blue color forming-layers are stacked directly upon each other, such that the coupler in at least one of the unit layers in each color-forming layer is of similar color to the coupler in the adjacent unit layer of the adjacent color forming layer.

6. A silver halide light-sensitive material according to claim 4, wherein the couplers in the unit layers of the red color-forming layer have substantially the same color sensitivity, the couplers in the unit layers of the green color-forming layer have substantially the same color sensitivity, and the couplers in the unit layers of the blue color-forming layer have substantially the same color sensitivity.

7. A color filter comprising blue, green, red and black parts prepared by subjecting the silver halide light-sensitive material according to claim 4 to pattern exposure, color development, bleach-fixing and water washing.

8. A method of preparing a color filter, comprising subjecting the silver halide light-sensitive material according to claim 4 to pattern exposure, color development, bleach-fixing and water washing.

* * * * *